US006012646A

United States Patent [19]

Young et al.

[11] Patent Number: 6,012,646

[45] Date of Patent: Jan. 11, 2000

[54] RECIRCULATING GEAR PUMP FOR VEHICLE HEATER

[76] Inventors: Jonathan Young, 832 East 21st Street, Vancouver, Canada, V5V 152; Bruce Conrad Wilnechenko, 6290 Portland Street, Burnaby, Canada, V5J 2R2

[21] Appl. No.: 09/013,283

[22] Filed: Jan. 26, 1998

[51] Int. Cl.[7] ..... B05B 9/00

[52] U.S. Cl. ..... 239/126; 239/124; 222/424

[58] Field of Search ..... 239/124, 126; 222/318, 424

[56] References Cited

U.S. PATENT DOCUMENTS

| | | | |
|---|---|---|---|
| 1,791,012 | 2/1931 | Ray | 239/126 |
| 3,258,054 | 6/1966 | Sherman | 239/126 |
| 4,718,602 | 1/1988 | Beck et al. | 237/32 |

*Primary Examiner*—Kevin Shaver
*Assistant Examiner*—David Deal
*Attorney, Agent, or Firm*—Liniak, Berenato, Longacre & White, LLC

[57] ABSTRACT

A fuel delivery apparatus for an auxiliary vehicle heater includes a burner with a fuel nozzle. A fuel pump has an intake port and a discharge port. There is a first fuel conduit connected to the intake port. A second fuel conduit connects the discharge port to the nozzle. A third fuel conduit extends between the discharge port and the intake port. A pressure release relief valve is operatively disposed along the third conduit. Fuel from the discharge port is recirculated back to the intake port when pressure of fuel supplied to the nozzle through the second conduit exceeds a preset amount. Preferably the fuel nozzle is an air aspirated fuel nozzle and the fuel pump is a gear pump. The third conduit may be internal to the fuel pump.

9 Claims, 7 Drawing Sheets

RECIRCULATING GEAR PUMP FOR VEHICLE HEATER

BACKGROUND OF THE INVENTION

This invention relates to auxiliary vehicle heaters and, in particular, to gear pumps used in conjunction therewith.

Auxiliary vehicle heaters are heaters which are independent of the conventional heaters used in vehicles which are actually heat exchangers transferring heat from the engine coolant. Auxiliary vehicle heaters are usually powered by fuel drawn from the conventional fuel tank of the vehicle. These heaters have a fuel nozzle associated with a burner and a combustion chamber. A fuel pump conventionally draws the fuel from the fuel tank and supplies it to a nozzle of the burner.

In conventional units, fuel is supplied at a relatively high pressure to the nozzle. The pumps are designed so they have the capacity to initially suck the air and lift the fuel from the fuel tank. This requires a relatively high displacement pump. The priming operation requires 8 to 10 times the capacity of pump needed to deliver fuel during normal heater operation. Excess fuel from the fuel pump is returned to the vehicle fuel tank by a fuel return line. Such a fuel return line is disadvantageous for a number of reasons, chiefly the hazard of fuel spillage should the return line be damaged. Also the incorporation of the return line increases the costs and complexity of an auxiliary heater installation.

High pressure fuel systems are, by their nature, prone to fuel leaks through the shaft seal of the pump, through the relief seal, solenoid seal and nozzle seal. Fuel cannot be recirculated within the fuel pump of high pressure fuels systems because of the detrimental effects of large pressure changes. Thus high pressure systems require a fuel return line and draw as much as ten times the fuel required by the burner. They require a large supply line and an additional pressurized return line and associated systems. These relatively complicated installations therefore have a potential for fuel leaks.

Accordingly, there is a need for of fuel supply system for auxiliary vehicle heaters which overcomes these disadvantages.

It is therefore an object of the invention to provide an improved fuel delivery system for auxiliary vehicle heaters which significantly reduces the risks of fuel spillage associated with conventional high pressure systems.

It is another object of the invention to provide an improved fuel delivery system for auxiliary vehicle heaters which eliminates the high flow rates associated with prior art units.

It is further object of the invention to provide an improved fuel delivery system which eliminates the need for a fuel return line extending from the pump to the fuel tank of vehicle.

It is also an object of the invention to provide an improved fuel delivery system for auxiliary vehicle heaters which is simpler and more robust than conventional high pressure systems.

SUMMARY OF THE INVENTION

According to the invention there is provided a fuel delivery apparatus for an auxiliary vehicle heater with a burner having a fuel nozzle. The fuel pump has an intake port and a discharge port. A first fuel conduit is connected to the intake port. A second fuel conduit connects the discharge port to the nozzle. This may be via a regulator. A third fuel conduit extends between the discharge port and the intake port. The pressure relief valve is operatively disposed along the third conduit. Fuel from the discharge port is recirculated back to the intake port when the pressure of fuel supplied to the nozzle through the second conduit exceeds a preset amount.

In a preferred embodiment of the invention, the fuel pump has a body, the third fuel conduit and the pressure relief valve being within the body.

DETAILED DESCRIPTION OF THE PREFERRED EMBODIMENTS

Figure 1:
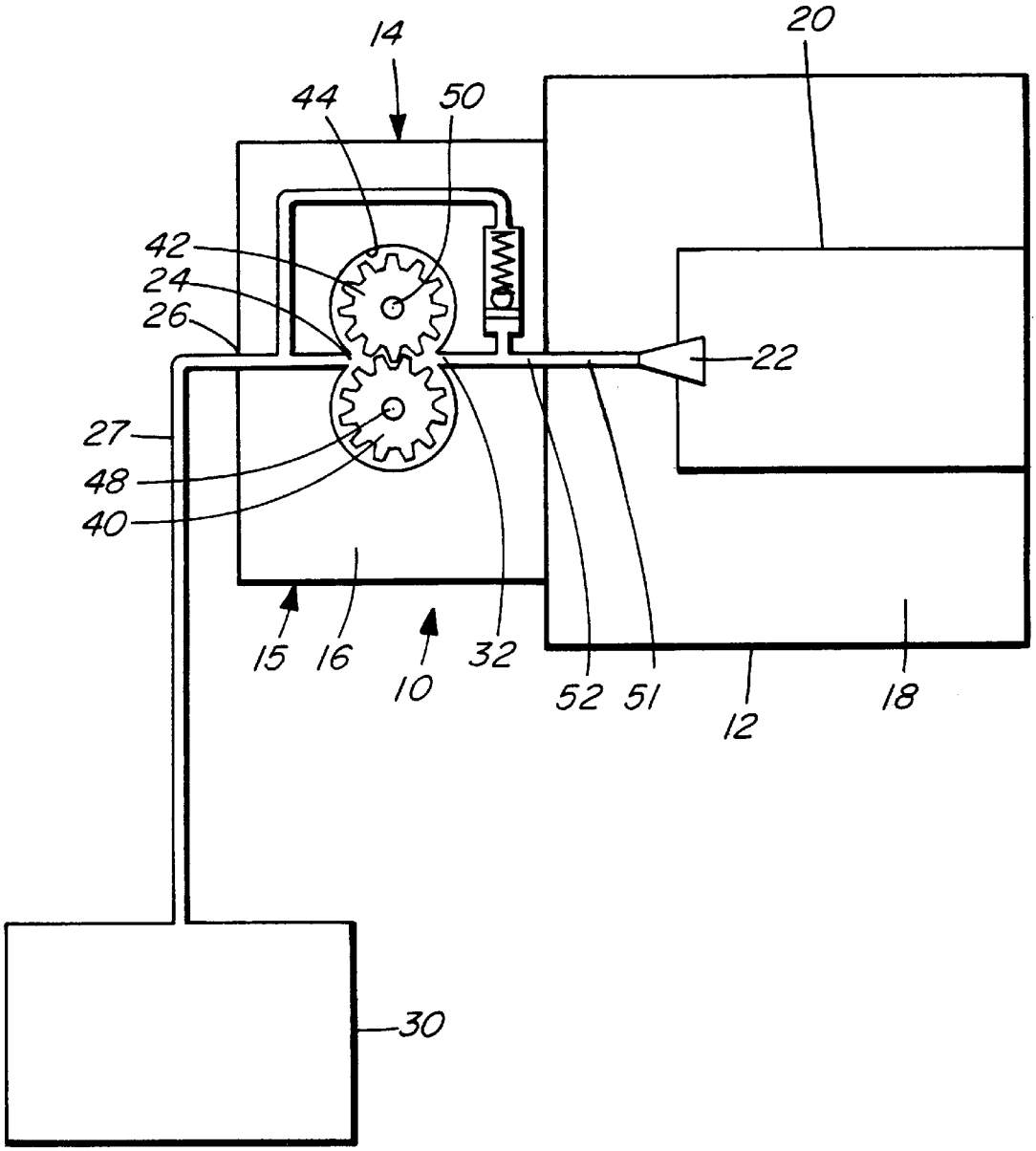
FIG. 1 is a diagrammatic view of an auxiliary vehicle heater including a fuel delivery system according to an embodiment of the invention.
Figure 5:
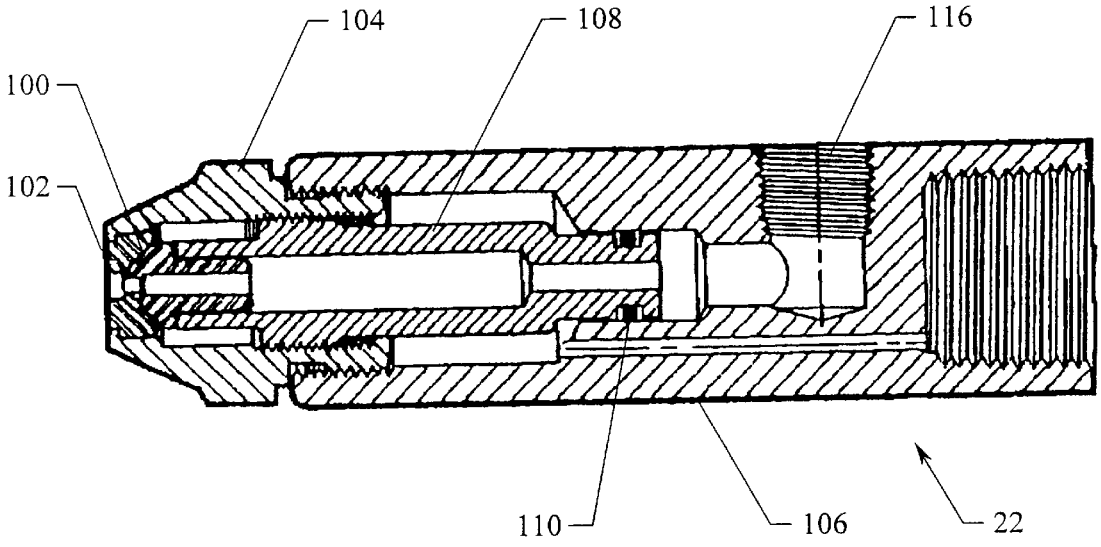
FIG. 5 is a sectional view of the nozzle thereof.

Referring to drawings, and first to FIG. 1, this shows an auxiliary vehicle heater 10 including a burner 12, with an aluminum body in this example, and a fuel pump 14 in a fuel delivery unit 15 having a body 16. The burner has a body 18 with an internal combustion chamber 20 and fuel nozzle 22. In this example, the fuel nozzle is an air aspirated nozzle shown in better detail in FIG. 5. The nozzle has a distributor 100, an orifice disk 102, a nozzle body 104 and an adapter 106. There is a screw pin 108 with an O ring 110. The nozzle has an air inlet 114. There is also an oil inlet, or fuel inlet 116. There is an associated flame shield 21, flame sensor 23 and electrode 25 shown in FIG. 2.

The fuel pump has an intake port 24 which is connected to a first fuel conduit 26 which, in turn, is connected to a fuel tank 30 of a vehicle where the heater is installed as seen in FIG. 1. The pump also has a discharger port 32. A pair of gears 40 and 42, shown in FIG. 1, 3*d* and 3*e*, are rotatable within a close fitting chamber 44. The ports communicate with the chamber. Gear 40 is connected to a powered shaft 48, while gear 42 is connected to an idler shaft 50. In this particular example the shaft 48 is coupled to an electric motor although other means could be employed for powering the pump.

Figure 2:
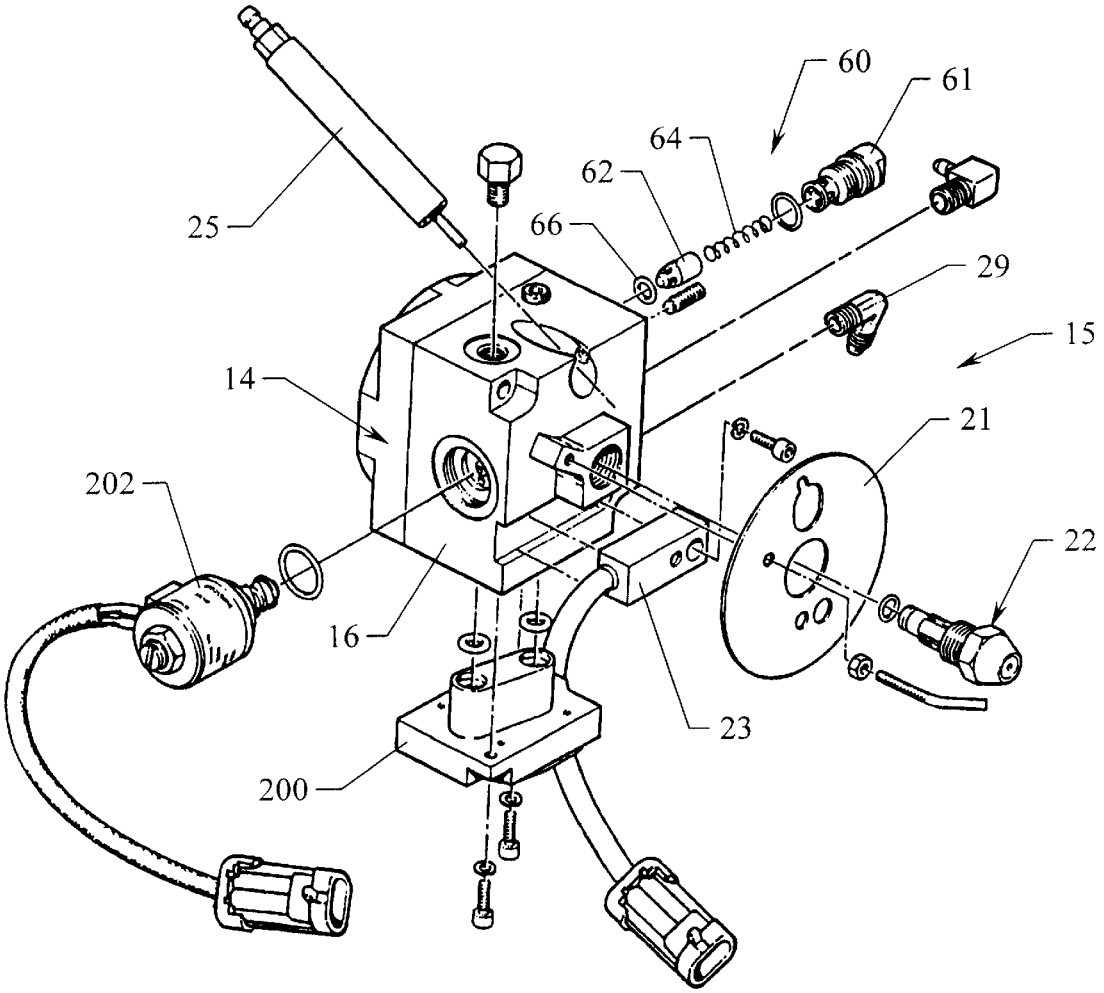
FIG. 2 is an exploded view of the fuel delivery unit of thereof.
Figure 3A:
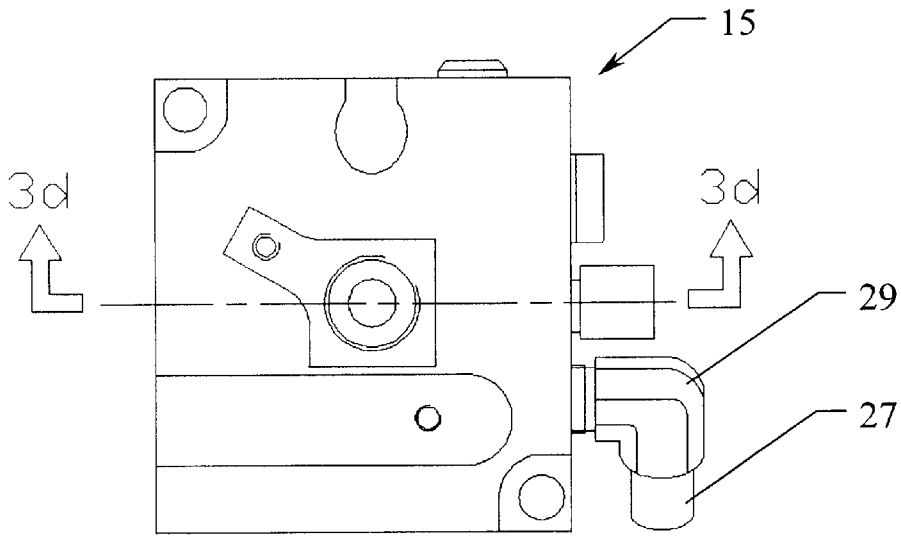
FIG. 3*a* is a side elevation thereof.
Figure 3B:
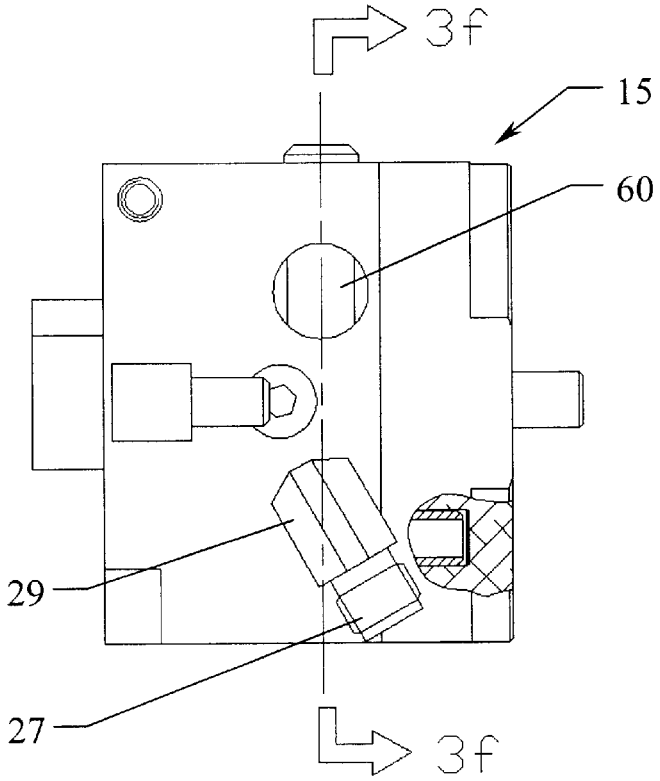
FIG. 3*b* is an end view thereof.
Figure 3C:
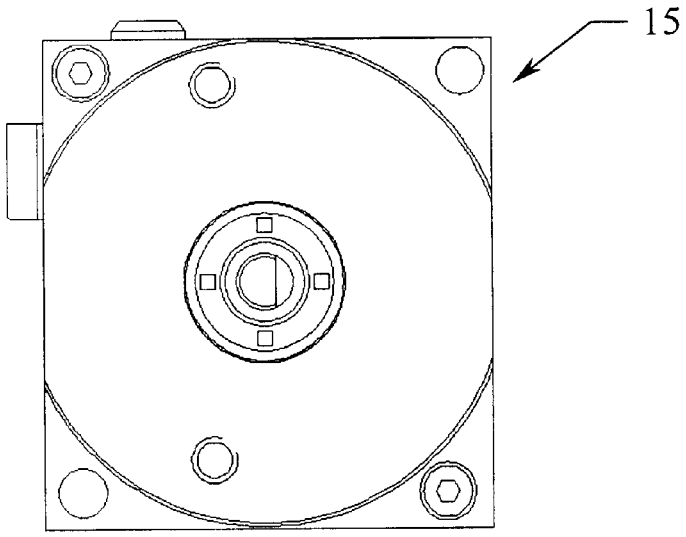
FIG. 3*c* is a side view of the side opposite FIG. 3*a*.
Figure 3D:
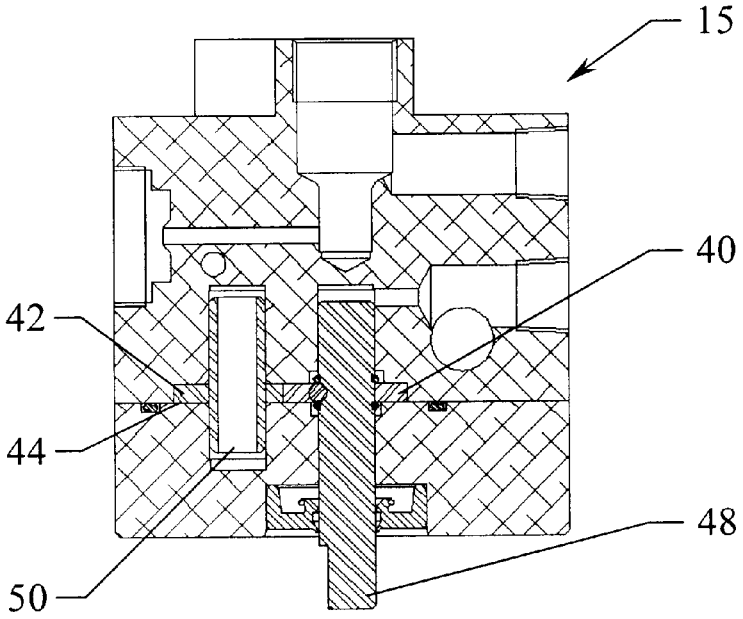
FIG. 3*d* is a section taken along line 3*d*—3*d* of FIG. 3*a*.
Figure 3E:
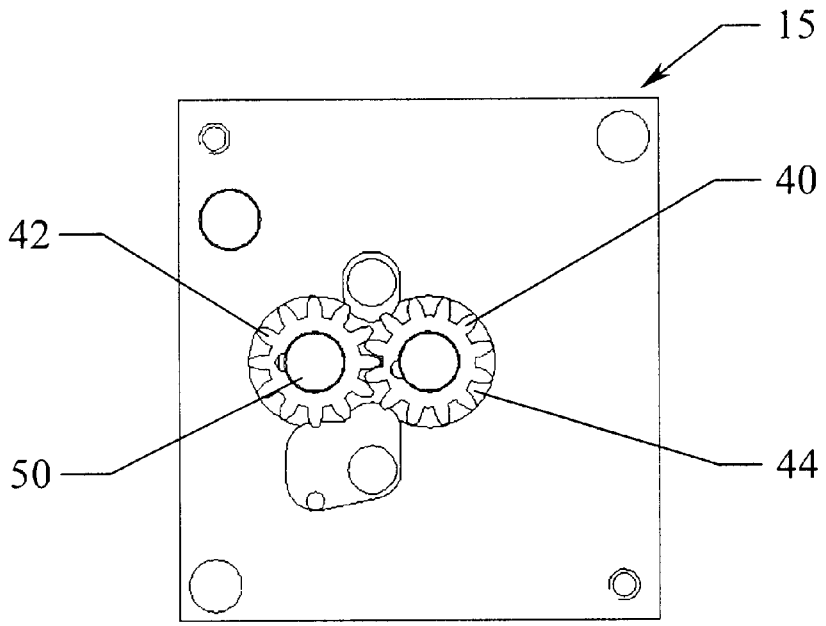
FIG. 3*e* is a sectional view, partly broken away, taken along line 3*e*—3*e* of FIG. 3*d*.
Figure 3F:
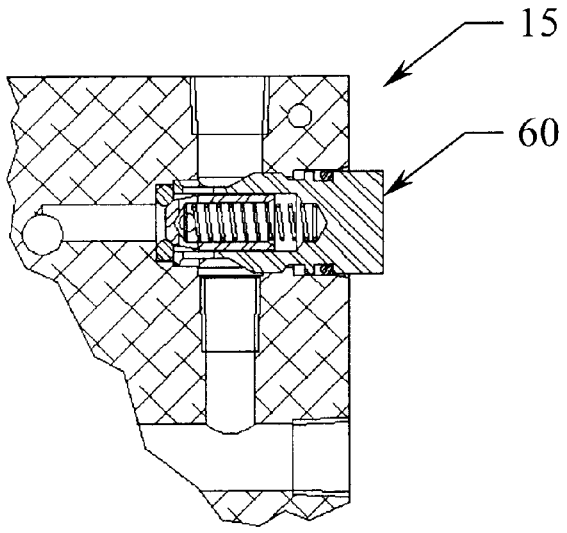
FIG. 3*f* is a fragmentary sectional view taken along line 3*f*—3*f* of FIG. 3*b*.
Figure 4:
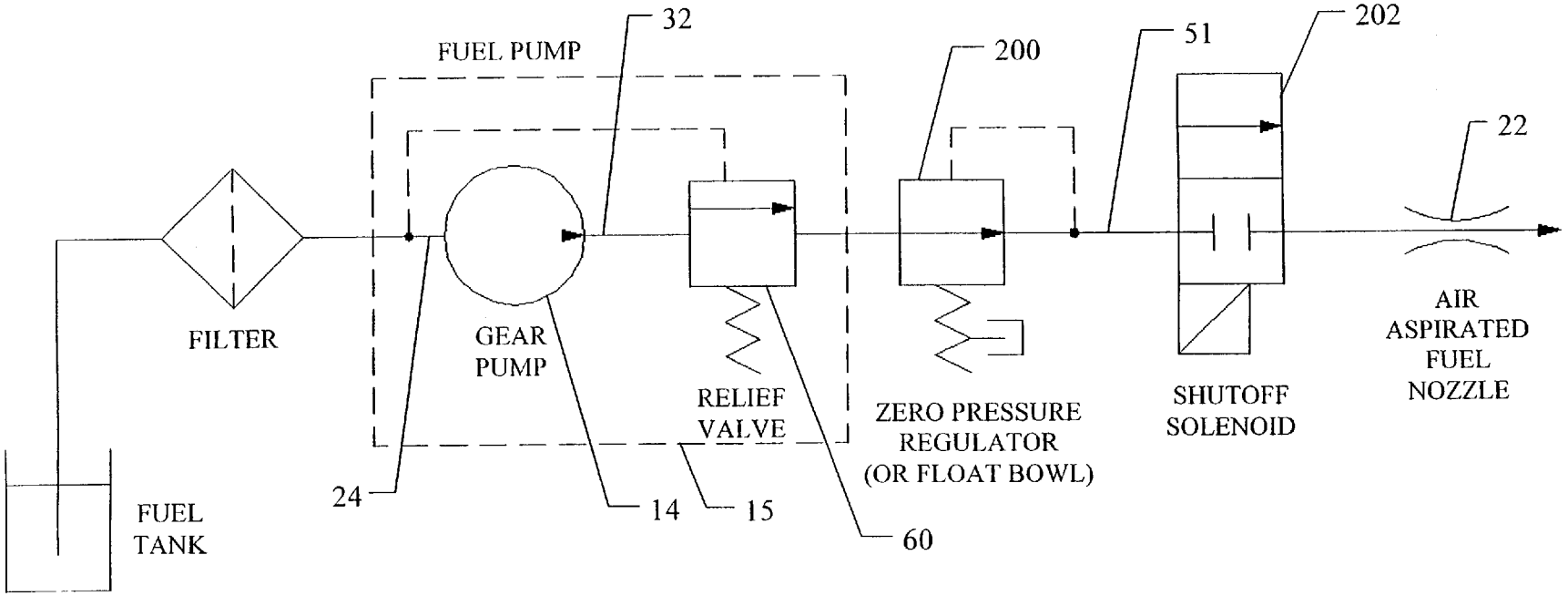
FIG. 4 is a schematic diagram of the auxiliary vehicle heater.

In the conventional manner, as the gears rotate, they draw fuel from the tank 30, through fuel line 27, elbow 29, shown in FIG. 2, 3*a* and 3*b*, through the first conduit 24 and port 26 into the chamber 44. The fuel is pressurized by the gears and discharged from the chamber through port 32 shown in FIG. 1.

Fuel discharged from the chamber 44 is fed to the nozzle 22 by a second fuel conduit 51 including a portion 52 within body 16 of the unit 15. Third fuel conduit 54 extends between the discharge port 32 and the intake port 24. In this particular example the conduit 54 is internal to the body 16 of the unit 15. A pressure relief valve 60 is operatively disposed along the third conduit. The valve includes a body 61, a poppet 62 and a coil spring 64. There is also an O-ring 66 which serves as a seat for poppet 62. Spring 64 biases the poppet towards O-ring 66, thus preventing a flow of liquid through the conduit 54. There is also a pressure regulator 200, a zero pressure regulator in this example, connected between nozzle 22 and solenoid 202. The pressure regulator is similar to those conventionally used in chain saws.

Operation of the pump and heater starts when the pump is primed. During priming the poppet 62 is seated against the O-ring 66. The poppet is held in this position by the spring 64. A priming vacuum, approximately equal to the relief valve setting, but also dependent on part clearances, is reached. After the fuel pump 14 is primed, fuel for combustion flows to the nozzle 22 through conduit 51, fuel regulator 200 and solenoid 202. After the set fuel pressure is reached, spring 64 is deflected and poppet 62 moves away from the O-ring 66. Excess fuel flows past the poppet 64 and back to the inlet side of the pump through conduit 54.

Overheating of the fuel is prevented by using an air aspirated fuel nozzle and lowering the fuel pressure so that overheating does not occur. The system operates at a very low pressure, about 9 psi in this example, and is completely contained within the body of the fuel pump.

The fuel is recirculated within the body of the gear pump, thus eliminating the return line to the fuel tank and high fuel flow rates. Only the fuel being burned is drawn by the fuel pump. Since there is no fuel return line from the tank and the supply line is a suction line, there is no potential for fuel leaks between the fuel tank and the air.

It will be recognized by someone skilled in the art that many of the details describedabove are by way of example only and are not intended to limit the scope of the invention which is to be interpreted with reference to the following claims.

What is claimed is:

1. A fuel delivery apparatus for an auxiliary vehicle heater, comprising:

a fuel nozzle;

a fuel pump having an intake port and a discharge port;

a first fuel conduit connected to the intake port;

a second fuel conduit connecting the discharge port to the nozzle;

a third fuel conduit extending between the discharge port and the intake port; and a pressure relief valve operatively disposed along the third conduit, whereby fuel from the discharge port is recirculated back to the intake port when pressure of fuel supplied to the nozzle through the second conduit exceeds a preset amount.

2. An apparatus as claimed in claim 1, wherein the fuel nozzle is an air aspirated fuel nozzle.

3. An apparatus as claimed in claim 1, wherein the fuel pump is a gear pump.

4. An apparatus as claimed in claim 1, wherein the pressure relief valve is a poppet valve.

5. An apparatus as claimed in claim 1, wherein the the pressure relief valve includes a resiliently biased valve member.

6. An apparatus as claimed in claim 5, wherein the valve member is resiliently biased by a spring.

7. An apparatus as claimed in in claim 1, wherein there is a fuel regulator connected along the second fuel conduit between the discharge port and of the nozzle.

8. An apparatus as claimed in claim 7, wherein the regulator is zero pressure regulator.

9. An apparatus as claimed in claim 1, wherein the nozzle is a low pressure nozzle.

* * * * *